United States Patent [19]

Finsterwalder

[11] 4,155,323

[45] May 22, 1979

[54] FLOAT CONSTRUCTION FOR REDUCING PITCHING, ROLLING OR DIPPING

[75] Inventor: Klemens Finsterwalder, Mörlbach, Fed. Rep. of Germany

[73] Assignee: Dyckerhoff & Widmann Aktiengesellschaft, Munich, Fed. Rep. of Germany

[21] Appl. No.: 817,505

[22] Filed: Jul. 20, 1977

[30] Foreign Application Priority Data

Jul. 21, 1976 [DE] Fed. Rep. of Germany ..... 2632813

[51] Int. Cl.[2] ..... B63B 35/44

[52] U.S. Cl. ..... 114/264; 9/8 P; 114/125

[58] Field of Search ..... 114/256, 257, 258, 264, 114/265, 266, 267, 263, 125; 9/8 P, 11 R, 1.3

[56] References Cited

U.S. PATENT DOCUMENTS

| | | | |
|---|---|---|---|
| 1,667,255 | 4/1928 | Hermanson | 114/264 |
| 2,858,790 | 11/1958 | Russel, Jr. | 9/11 R X |
| 3,123,843 | 3/1964 | Tangen | 9/11 R |
| 3,276,209 | 10/1966 | Mosdell | 114/266 X |
| 3,520,008 | 7/1970 | Frieder et al. | 9/11 R |

*Primary Examiner*—Edward R. Kazenske
*Assistant Examiner*—Sherman D. Basinger
*Attorney, Agent, or Firm*—Toren, McGeady and Stanger

[57] ABSTRACT

A float construction is formed of at least one closed storage chamber arranged to float on the surface of a body of water with walls extending downwardly from the storage chamber and forming a plurality of chambers open at the lower ends. When the storage chamber is floated, water completely fills the chambers below the storage chamber so that the natural frequency of the float construction is varied for the different vibrations to which it is exposed.

7 Claims, 5 Drawing Figures

FLOAT CONSTRUCTION FOR REDUCING PITCHING, ROLLING OR DIPPING

SUMMARY OF THE INVENTION

The present invention is directed to a float construction primarily for use in a stationary operation and, more particularly, it concerns an arrangement for reducing pitching, rolling or dipping.

One of the prerequisites for the use of floating platforms and tanks in the exploration and exploitation of oil fields in off shore regions is the ability to maintain a steady floating position. A floating member resting on the water surface in the open sea is exposed to wind and waves which cause vibrations or oscillations that have an unfavorable effect on the equipment mounted on the platform. In semi-submerged floating platforms the float member is located in the water so that it is hardly affected by the movement of the waves. The platform is supported from the float member by slim columns. Any wave action is effected directly on the columns and, since they are slim, the influence of the waves on the stability of the floating platform can be checked.

One disadvantage of these semi-submerged floating platforms is that they must be trimmed very accurately and they react very sensitively to different load distributions, both in manufacture and operation. As a result, the mass of such semi-submerged floating platforms must be three times greater than a float bearing directly on the surface, because the floats bearing on the surface can not only eliminate lifting and ballast tanks, but the water pressures are very low because of the relatively shallow draft.

The main problem experienced in float constructions bearing on the water surface, however, is the behavior of the float member as a result of exposure to various motions, since the float member is fully exposed to oscillation or vibration generating forces of the waves. It has been known to damp such vibrations by moving liquids or by mechanical devices. These damping means are frequently very elaborate and cannot be readily applied to a very large float member, such as a floating platform. Therefore, the primary object of the present invention is to provide a more steady floating behavior for a float member with a minimum of expenditure so that the float member is not too readily influenced.

In accordance with the present invention, a plurality of chambers open at the bottom are provided extending downwardly from the lower surface of the float member so that they can be completely filled with water when the member floats on the water surface so that the natural frequency of the overall construction is varied for the different vibrations to which it is exposed. While these chambers are open at the lower end they are closed on all other sides and at least one opening to the atmosphere, which can be sealed in an airtight manner, is provided for each chamber.

Preferably, the float member is laterally enclosed about its outer periphery by a downwardly extending vertical wall. This vertical wall forms the outer surface of the open-ended chambers and the other walls or partitions of the chambers are provided by walls extending radially inwardly from the outer wall toward the center of the float member or by walls located radially inwardly from and parallel to the outer wall.

The present invention is based on the finding that the magnitude of movements of a float construction resting on the water surface depends substantially on the natural frequency of the construction for the various types of vibrations (rolling, pitching, dipping) and on the damping of these vibrations. The natural frequency of the float can be influenced only by its mass distribution and over the ratio of the total mass to the buoyant forces.

The advantage of the float construction embodying the present invention is that the water masses contained in the chambers with the open lower ends are held in the chambers as the float member is exposed to movement and enter fully into the inertia forces of the float construction. Accordingly, the float member does not noticeably react to the various types of wave action to which it is exposed. Further, the natural frequency of the float construction can be adapted in a simple manner, that is, by providing a depth of the chambers corresponding to the range of wave action to be expected. At the same time, an excellent damping effect is afforded by the walls forming the chambers for the rolling and pitching vibrations as well as the damping vibrations by means of the eddies produced at the edges of the walls.

In addition to favorably influencing the vibration behavior of the float construction, the present invention also affords advantages in its production. The downwardly extending lower chambers which are filled with water when the construction is afloat, are filled with air during construction so that the chambers can be completely filled for the maximum beneficial use. In addition to providing a much lower draft for the float member during operation, as compared to a semi-submerged floating platform, there are additional advantages in providing low dock depths.

Preferably, the float construction embodying the present invention is formed of reinforced concrete or prestressed concrete.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
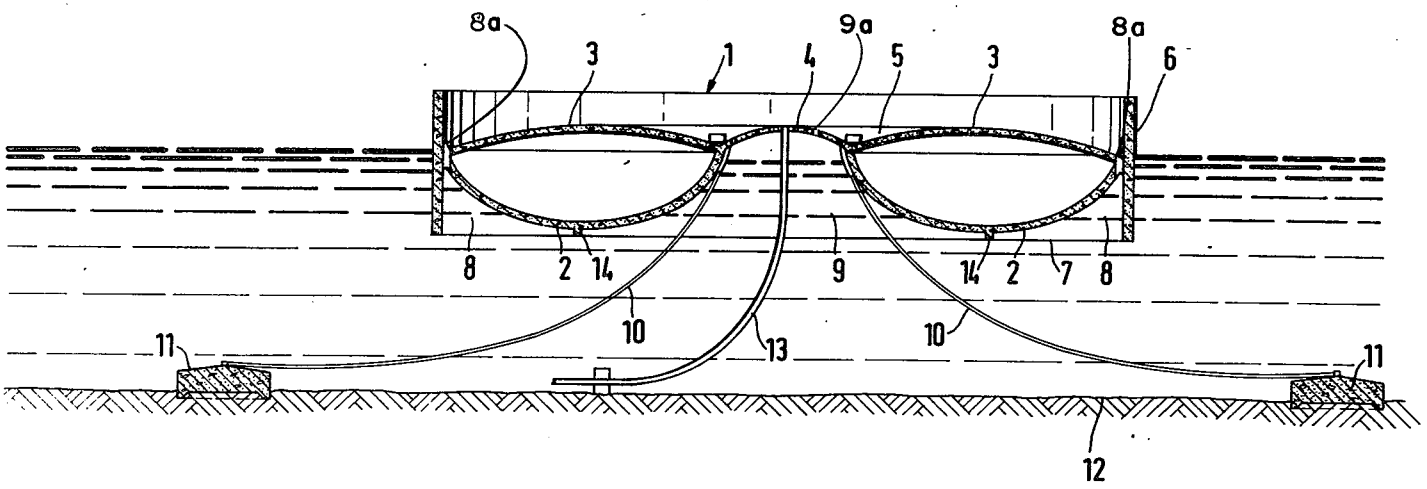
FIG. 1 is a vertical sectional view through a float construction embodying the present invention, with the float member being in the form of a closed annular chamber.
Figure 2:
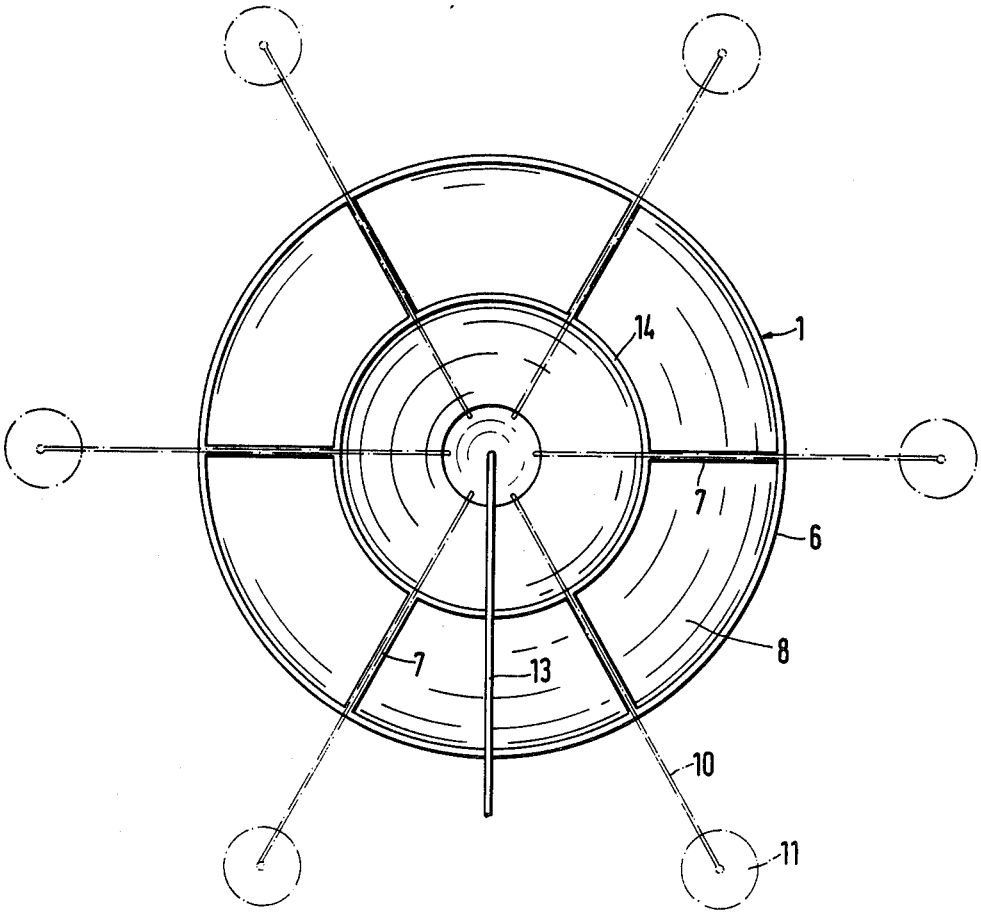
FIG. 2 is a bottom view of the float construction shown in FIG. 1.

In FIGS. 1 and 2, a float construction 1 is illustrated formed of reinforced concrete or prestressed concrete. The float construction includes a storage tank or chamber which can be used for storing crude oil, liquid gas and the like. Guy ropes 10, attached at one end to the float construction, are secured at the other end to blocks 11 which are lowered to the bottom of the body of water 12. A pipeline 13 leads from the float construction downwardly to bores formed in the subsurface of the body of water.

The float construction 1 includes a hollow toroidal body of revolution in the form of an annular storage tank or chamber having a vertical axis. The storage chamber consists of a dish-shaped bottom plate 2 preferably curved in a semi-elliptical form and of a top plate of a somewhat flatter curved construction. The bottom plate 2 has a concave upwardly facing surface while the top plate 3 has a concave downwardly facing surface. The radially inner and outer edges of the plates are connected to one another. The central opening provided by the annular chamber is covered by a closure member 4. Radial fins 5 extending radially outwardly from the vertical axis of the chamber to the crown of the top plate 3, serve as reinforcement and, if necessary, as a support for a planar top surface, not shown, if the float construction is used as a platform for a drilling island for the construction of a liquefying plant.

The outer circumference of the float construction, that is, the outer peripheral edge of the storage chamber, is surrounded by a vertically extending cylindrical wall 6 which extends both above and below the surface of the body of water on which the float member rests. Below the downwardly facing surface of the lower plate 2, radial partitions 7 extend inwardly from the cylindrical wall to the lowermost point on the lower surface of the bottom plate. These radially extending partitions 7, in combination with the wall 6 and the bottom plate 2, form chambers 8, note FIG. 2, open at their lower ends. These chambers 8, like the chamber 9 formed in the open center of the storage chamber, are filled with water when the float member rests on the surface of a body of water. The depth of the wall 6 below the water surface can be adapted to the inertia forces to be developed. If wall 6 extends downwardly below the lowermost point on the lower surface of the bottom plate 2, an additional inner ring wall 14 is provided to separate the radially outer chambers 8 from the central chamber 9.

Since the chambers 8 and 9 are filled with air during construction, valve-type openings 8*a*, 9*a* open to the atmosphere so that air enclosed within the chambers can escape when the float construction is launched. While afloat, these openings are closed.

While the float construction is supported on the surface of the body of water, the water masses enclosed in the chambers 8 and 9 are retained by atmospheric air pressure in the chambers during wave movements and, accordingly, they enter fully into the inertia forces of the float construction. At the same time, movement of the enclosed water masses is prevented by the walls 7 and 14. If any movement of the water masses tends to develop, eddies are produced primarily at the lower edges of the walls 6, 7 and 14, which effectively damp such movements. Tests have shown that the behavior of the float construction according to the present invention is at least the equivalent to that of semi-submerged platforms in wide ranges and the advantages in manufacture and operation, that is, with regard to floating stability and security against capsizing, are clearly superior. These measures afforded by the present invention can also be utilized in the semi-submerged floating platforms as additional damping measures.

While FIG. 1 shows an annular float member, the invention is not limited to this specific form. As can be noted in FIGS. 3, 4 and 5, the float member can have a rectangular base while providing substantially the same advantageous effects.

Figure 3:
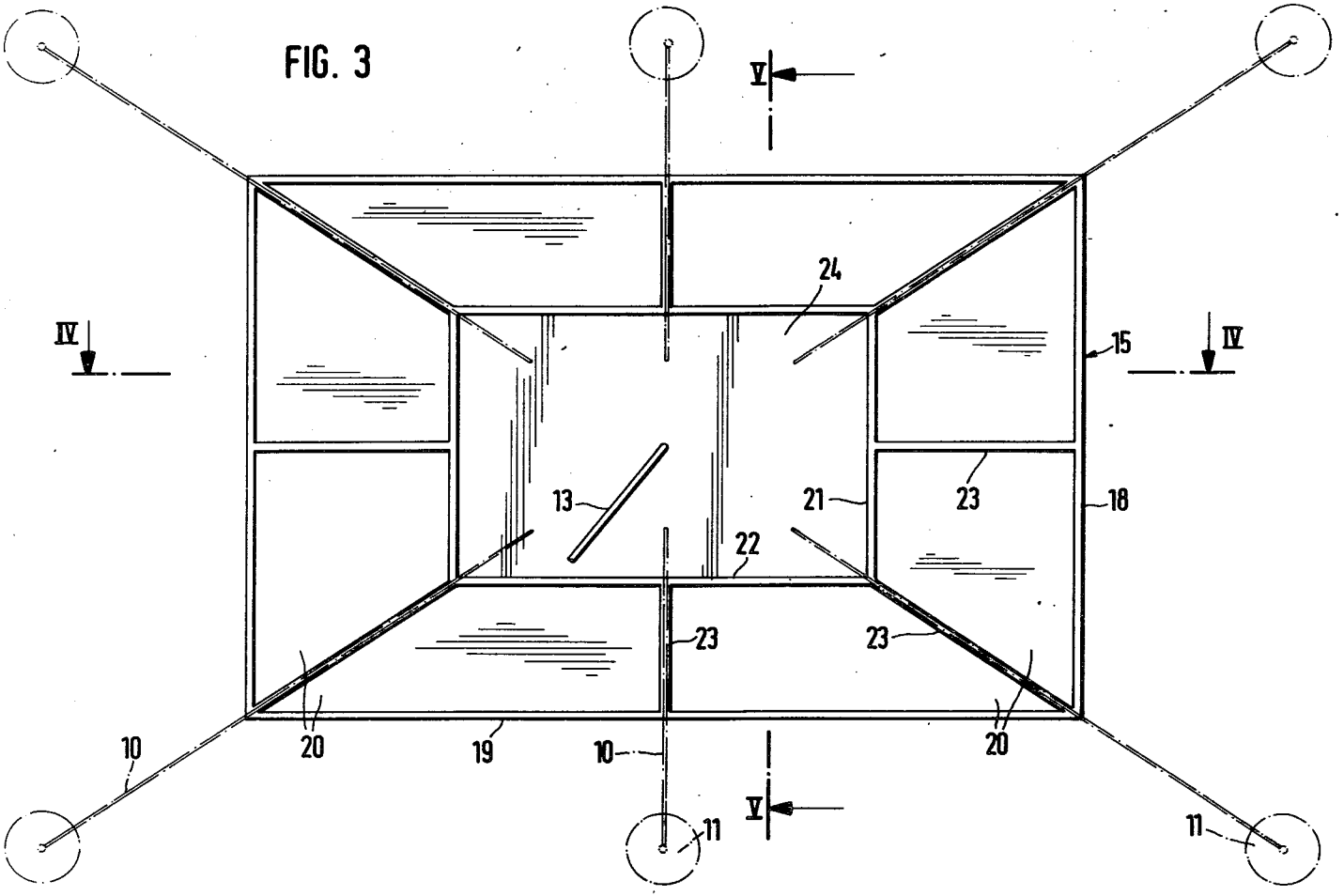
FIG. 3 is a bottom view of another float construction embodying the present invention, with the float member having a rectangularly shaped base.
Figure 4:
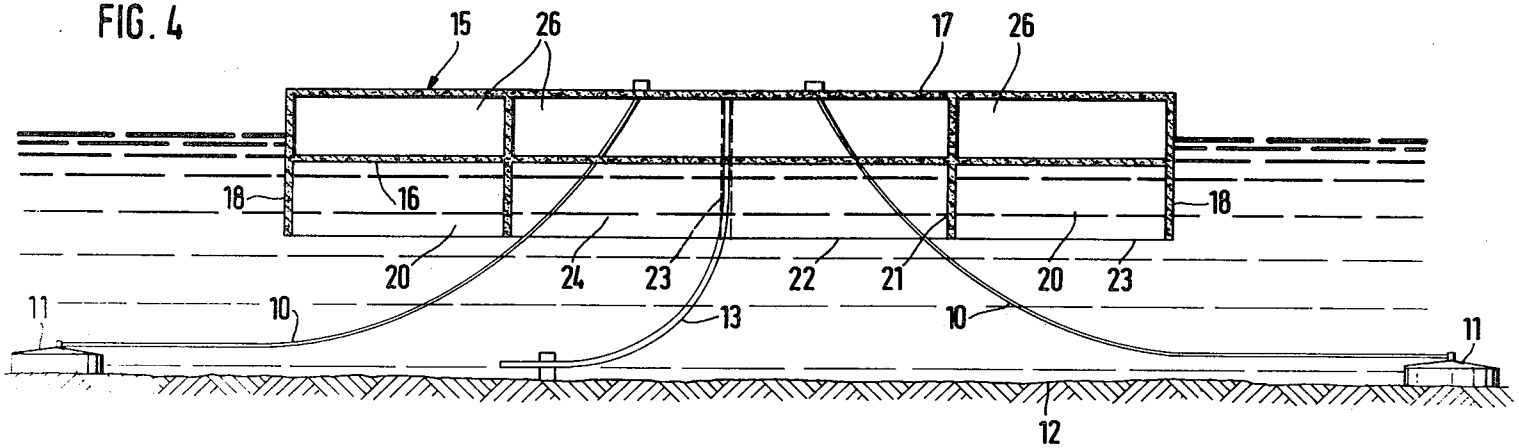
FIG. 4 is a sectional view taken along the line IV—IV in FIG. 3.
Figure 5:
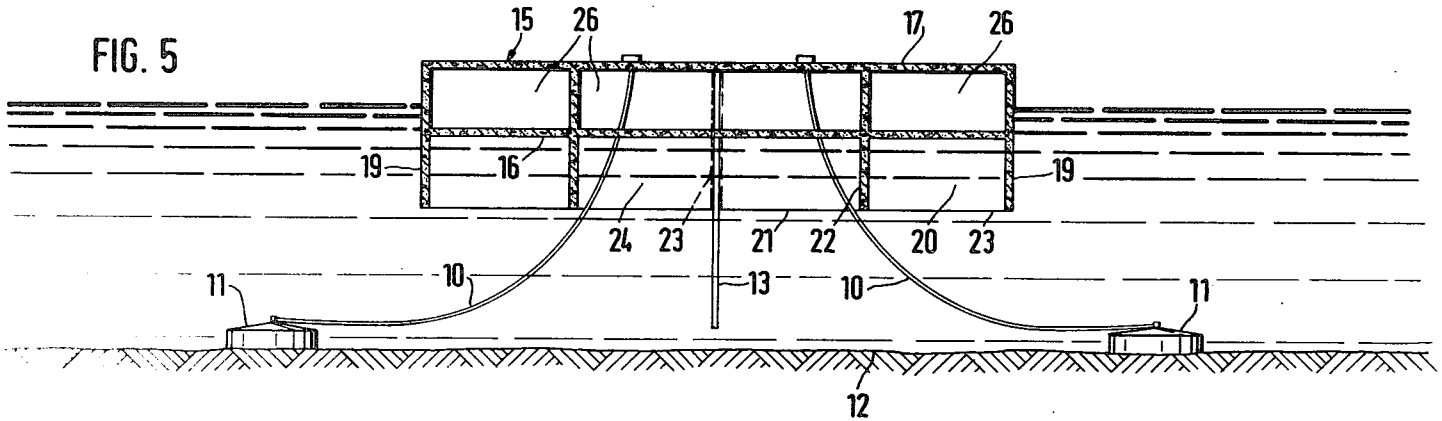
FIG. 5 is a transverse cross section taken along the line V—V in FIG. 3.

In FIGS. 3–5, the float construction 15 includes a float member defined by a bottom plate 16, a top plate 17, and end walls 18 and 19, with the end walls 18 being shorter in length than the end walls 19. The float construction is anchored on the bottom of the body of water by guy ropes 10 and blocks 11 in the same manner as set forth in FIGS. 1 and 2. Further, the pipeline 13 extends upwardly from the bottom of the body of water to the center of the float construction 15.

The vertical outer walls 18 and 19 of the float construction extend downwardly below the bottom plate. Further, inner walls 21, 22 extend downwardly from the top plate 17 to the same depth as the outer walls and, as can be seen in FIG. 3, are disposed in parallel relation with the outer walls. Further, partitions 23 extend radially inwardly from the outer walls to the inner walls. Accordingly, chambers 20 and 24 are formed below the bottom plate 16 so that water masses are held in these chambers in the same manner as in the chambers 8 and 9 of the float construction illustrated in FIGS. 1 and 2.

The outer walls 18 and 19, in combination with the inner walls 21 and 22 and the partitions 23 form chambers 26 between the bottom and top plates 16, 17 which form the storage tanks or chambers of the float construction 15 which can be used in any desired manner. As shown in FIGS. 4 and 5, the top surface of the float construction is planar and can be used as the base for a liquefying plant for natural gas or for a like use. Further, the float construction can be provided with piers at which tankers can dock. Conventional transfer equipment for unloading cargo can also be provided on the float construction.

While specific embodiments of the invention have been shown and described in detail to illustrate the application of the inventive principles, it will be understood that the invention may be embodied otherwise without departing from such principles.

What is claimed is:

1. A float construction for reducing the pitching, rolling or dipping of the float used primarily in a stationary position, such as a floating platform for use at offshore locations, comprising first wall means forming at least one closed storage chamber capable of floating on a body of water, said closed storage chamber having an upper surface and a lower surface with the lower surface arranged to float on or below the surface of the water and with the upper surface arranged in the position above the surface of the water, second wall means forming in combination with said first wall means a plurality of separate water chambers extending downwardly from the lower surface of said storage chamber with each of said water chambers being closed laterally and at the upper ends thereof and being open at the lower ends thereof so that with said storage chamber floating on the body of water said water chambers are completely filled with water and the natural frequency of the float construction is varied for the different vibrations to which it is exposed, said second wall means comprising a vertically arranged first wall connected to and extending completely about the outer periphery of said storage chamber, the lower end of said first wall extending downwardly at least to a horizontal plane containing the lowest point of said storage chamber, vertically arranged second walls connected to and extending radially inwardly from said first wall toward the center of the float, the upper ends of said second walls disposed in contact with the lower surface of said storage chamber, and at least one vertically arranged third wall spaced inwardly from said first wall and extending downwardly from the surface of said storage chamber, said first, second and third walls in combination with said lower surface of said first wall means forming said water chambers, said first wall means comprises a generally horizontally arranged annular shaped upper wall having a radially inner edge and a radially outer edge, a generally horizontally arranged annular shaped lower wall having a radially inner edge and a radially outer edge, the radially inner edges of said upper and lower walls connected to one another and the radially outer edges of said upper and lower walls connected to one another, the downwardly facing surface of said upper wall and the upwardly facing surface of said lower wall being concavely shaped, said first wall extends downwardly to a horizontal plane below the lowermost point of the lower surface of said lower wall and said third wall extends downwardly from the lowermost point of said lower wall and said second walls extend between said first and third walls.

2. A float construction, as set forth in claim 1, wherein each of said water chambers has an opening thereto sealed in an airtight manner and extending through one of said first and second wall means and being openable to the atmosphere above the water surface.

3. A float construction, as set forth in claim 1, wherein said first and second wall means being formed of reinforced concrete.

4. A float construction, as set forth in claim 1, wherein said first and second walls being formed of prestressed concrete.

5. A float construction, as set forth in claim 1, wherein the radially inner edges of said upper wall and lower wall define an opening, and a cover extending over and closing the opening so that the cover and the downwardly facing surface of said lower wall define a central water chamber.

6. A float construction, as set forth in claim claim 1, wherein said first wall extends upwardly above the horizontal plane containing the uppermost point on the upper surface of said upper wall.

7. A float construction for reducing the pitching, rolling or dipping of the float used primarily in a stationary position, such as a floating platform for use at offshore locations, first wall means forming one closed central storage chamber of horizontal rectangular section, and an annular arrangement of closed outer storage chambers laterally surrounding said central storage chamber with the radially inner boundary and outer boundary of said outer storage chambers having a horizontal rectangular shape, the lower surfaces of said central and outer storage chambers located in a common generally horizontally extending plane, second wall means forming in combination with said first wall means a plurality of separate water chambers extending downwardly from the plane of the lower surfaces of said central and outer storage chambers with each of said water chambers being closed laterally and at the upper ends thereof by the lower surfaces of said central and outer storage chambers and being open at the lower ends thereof so that with said storage chambers floating on the body of water said water chambers are completely filled with water and the natural frequency of the float construction is varied for the different vibrations to which it is exposed, said water chambers comprising a central water chamber aligned below said central storage chamber and an annular arrangement of outer water chambers laterally surrounding said central water chamber and aligned below said outer storage chambers, the radially outer boundary of said central water chamber being rectangular in horizontal section and forming the radially inner boundary of said outer water chambers and the radially outer boundary of said outer water chambers being rectangular in horizontal section, said second wall means comprising a vertically arranged first wall connected to and extending downwardly from and completely about the rectangular shaped outer periphery of said outer storage chambers, a vertically arranged second wall connected to and extending downwardly from and completely about the rectangularly shaped outer periphery of said central storage chamber, vertically arranged third walls extending radially relative to the center of said central water chamber and extending between said first and second walls and combining with said first and second walls for defining the vertical sides of said outer water chambers, and said first, second and third walls extending downwardly from the plane of the lower surfaces of said central and outer water storage chambers and terminating in a common horizontal plane.

* * * * *